US007243405B1

(12) United States Patent
Green

(10) Patent No.: US 7,243,405 B1
(45) Date of Patent: Jul. 17, 2007

(54) METHOD, SYSTEM, AND DEVICE FOR STORING CREMAINS

(76) Inventor: James Patrick Haffey Green, 6420 Commonwealth Dr., Roanoke, VA (US) 24018

( * ) Notice: Subject to any disclaimer, the term of this patent is extended or adjusted under 35 U.S.C. 154(b) by 0 days.

(21) Appl. No.: 11/219,984

(22) Filed: Sep. 6, 2005

Related U.S. Application Data

(60) Division of application No. 10/780,037, filed on Feb. 17, 2004, which is a continuation-in-part of application No. 10/351,125, filed on May 19, 2003, now abandoned.

(51) Int. Cl.
*A61G 17/00* (2006.01)

(52) U.S. Cl. ..... 27/1; 52/133; 52/134; 52/136; 27/35

(58) Field of Classification Search ..... 27/35, 27/1; 52/128, 133, 134, 136
See application file for complete search history.

(56) References Cited

U.S. PATENT DOCUMENTS 4,607,417 A * 8/1986 Hancovsky ..... 27/1
5,134,758 A * 8/1992 Christensen ..... 27/35
5,381,591 A * 1/1995 Ponger et al. ..... 27/35
5,692,344 A * 12/1997 Zarth ..... 52/137
5,765,269 A * 6/1998 Zarth ..... 27/26
5,881,505 A * 3/1999 Larkin et al. ..... 52/136
6,161,268 A * 12/2000 Joseph ..... 27/35
6,553,727 B2 * 4/2003 Thomas et al. ..... 52/136
6,578,323 B1 * 6/2003 Zartman et al. ..... 52/134

* cited by examiner

*Primary Examiner*—William L. Miller
(74) *Attorney, Agent, or Firm*—Michael Haynes PLC; Michael N. Haynes

(57) ABSTRACT

Certain exemplary embodiments comprise a device comprising: a first wooden portion comprising a substantially rectangular and substantially planar face interlocked to an opposing pair of substantially rectangular and substantially planar sides and to an opposing pair of substantially rectangular and substantially planar ends, the sides interlocked to said ends, said first wooden portion defining a cremains cavity; and a substantially planar wooden lid adapted to be attached to the first wooden portion and to permanently close said cremains cavity to form an airtight cremains space, the wooden lid comprising a plurality of vents adapted to vent the cremains cavity upon attachment of the wooden lid to the first wooden portion and to be sealed upon permanently closing of the cremains cavity.

20 Claims, 8 Drawing Sheets

METHOD, SYSTEM, AND DEVICE FOR STORING CREMAINS

CROSS REFERENCE TO RELATED APPLICATIONS

This application is a divisional of, claims priority to, and incorporates by reference in its entirety, pending U.S. application Ser. No. 10/780,037, filed 17 Feb. 2004, and titled "Method, System, and Device for Storing Cremains", which is a continuation-in-part of, claims priority to, and incorporates by reference in its entirety, abandoned U.S. application Ser. No. 10/351,125, filed 19 May 2003, and titled "Container".

BRIEF DESCRIPTION OF THE DRAWINGS

A wide variety of potential embodiments will be more readily understood through the following detailed description, with reference to the accompanying drawings in which.

DEFINITIONS

When the following terms are used herein, the accompanying definitions apply:

box-urn—a permanently sealed cremains urn that defines a cremains space and comprises an opposing pair of substantially rectangular and substantially planar sides coupled to an opposing pair of substantially rectangular and substantially planar ends coupled to a substantially rectangular and substantially planar face that opposes a substantially planar lid.

brick—a molded rectangular block of clay baked by the sun or in a kiln until hard and used as a building and/or paving material.

burial—the act of depositing a dead body or remains in the earth, in a tomb or vault, or in the water, usually with attendant ceremonies.

cap—a protective cover or seal.

capping—applying on top of.

cinerary—a place for keeping the ashes of a cremated body.

columbarium—a sepulchral facility with niches for holding cinerary urns.

course—a continuous layer of building material, such as brick or tile, on a wall or roof of a building.

cremains—cremated remains.

facade—a principal front of a structure, having some architectural pretensions.

face—the most significant or prominent surface of an object.

foundation—the basis on which a thing stands, is founded, or is supported.

interlock—to unite or join closely.

masonry—anything constructed of the materials used by masons, such as stone, brick, tiles, or the like.

mortared—joined with mortar.

mortise—a cavity in a piece of wood prepared to receive a tenon and thus form a joint.

niche—a recess in a wall.

rectangular—defined by four right angles.

roofing material—shingles, slate, seamed metal, shakes, terra cotta tiles, etc.

sepulchral—of or pertaining to a funeral, burial, tomb, vault, grave, and/or monuments erected to the memory of the dead.

structural masonry block—a usually hollow building block made with concrete.

tenon—a projection on the end of a piece of wood shaped for insertion into a mortise to make a joint.

tongue and groove joint—a mortise joint made by fitting a projection on the edge of one board into a matching cavity (e.g., groove, hole, etc.) on another board.

urn—a vessel or container of various forms.

wall—an upright architectural partition with a height and length greater than its thickness and serving to enclose, divide, define, or protect an area or to support another structure.

waterproof material—a weather resistant material that sheds water, such as pre-cast concrete, stone (e.g., marble, granite, etc.), roofing material, etc.

wood—the fibrous material which makes up the greater part of the stems and branches of trees and shrubby plants. Often used as a building material.

wooden—constructed primarily of wood.

DETAILED DESCRIPTION

Figure 1:
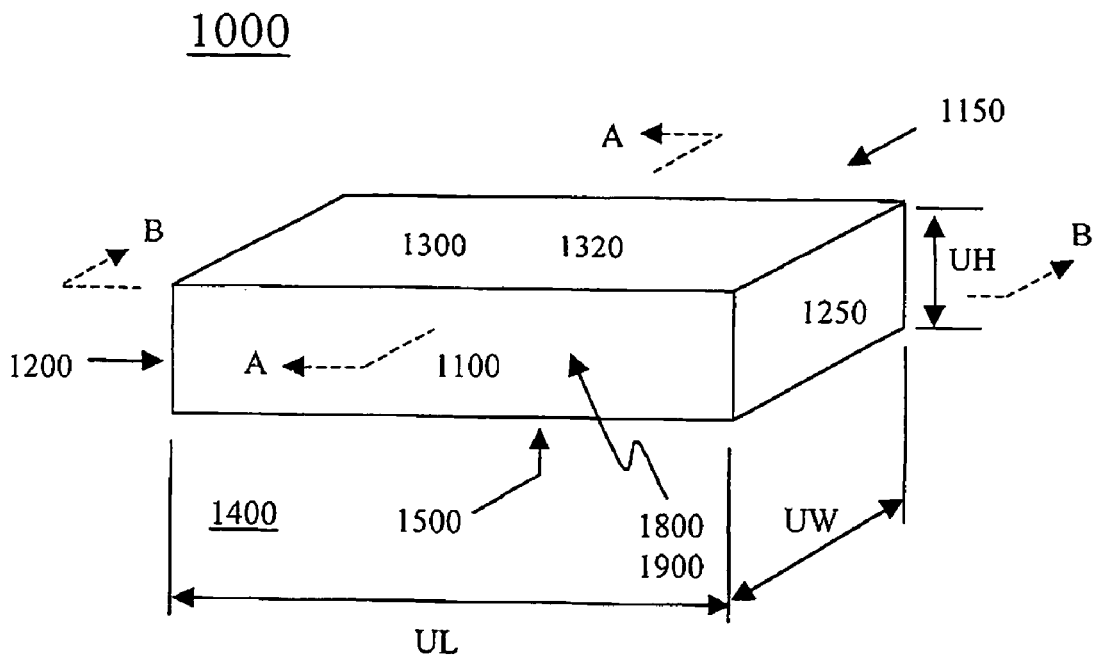
FIG. 1 is a perspective view of an exemplary embodiment of a box-urn 1000.

FIG. 1 is a perspective view of an exemplary embodiment of a cremains container and/or box-urn 1000, which can be comprised of a first portion 1400 to which a lid 1500 is adapted to be attached. First portion 1400 can comprise a face 1300, which can be substantially rectangular and/or substantially planar. First portion 1400 can comprise an opposing pair of sides 1100, 1150, either of which can be substantially rectangular and/or substantially planar. First portion 1400 can comprise an opposing pair of ends 1200, 1250, either of which can be substantially rectangular and/or substantially planar. Face 1300 can be interlocked to either or both of sides 1100, 1150. Face 1300 can be interlocked to either or both of ends 1200, 1250. Either or both of sides 1100, 1150 can be interlocked to either or both of ends 1200, 1250. First portion 1400 can define a cremains cavity 1800. Lid 1500 can be attached to first portion 1400 to close cremains cavity 1800 and form a cremains space 1900. If lid 1500 is attached permanently to first portion 1400, cremains space 1900 can be substantially airtight. Box-urn 1000 and/or first portion 1400 can be defined by a length UL, width UW, and/or height UH. In certain exemplary embodiments, the maximum value of UL, UW, and UH can be about 12 inches or less. In certain exemplary embodiments, box-urn 1000 and/or at least certain components thereof, can be manufactured from wood, such as walnut, oak, cherry, and/or pine.

Figure 3:
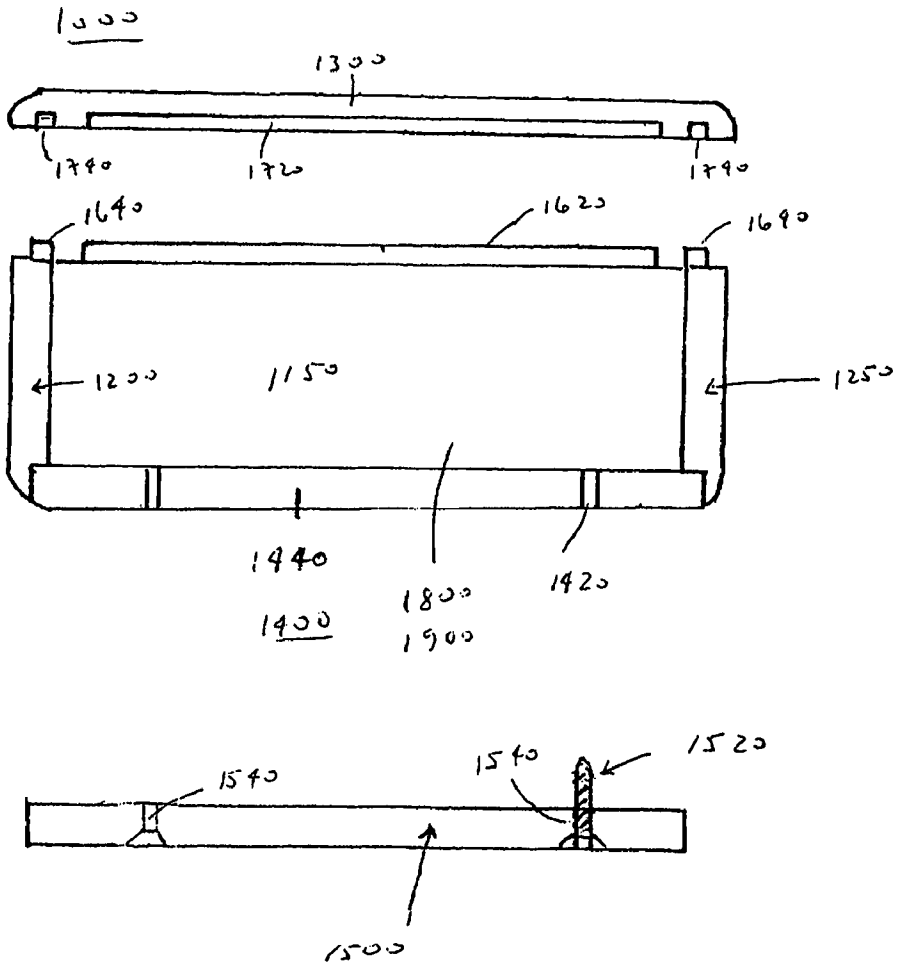
FIG. 3 is a cross-sectional assembly view, taken along line B-B of FIG. 1.
Figure 2:
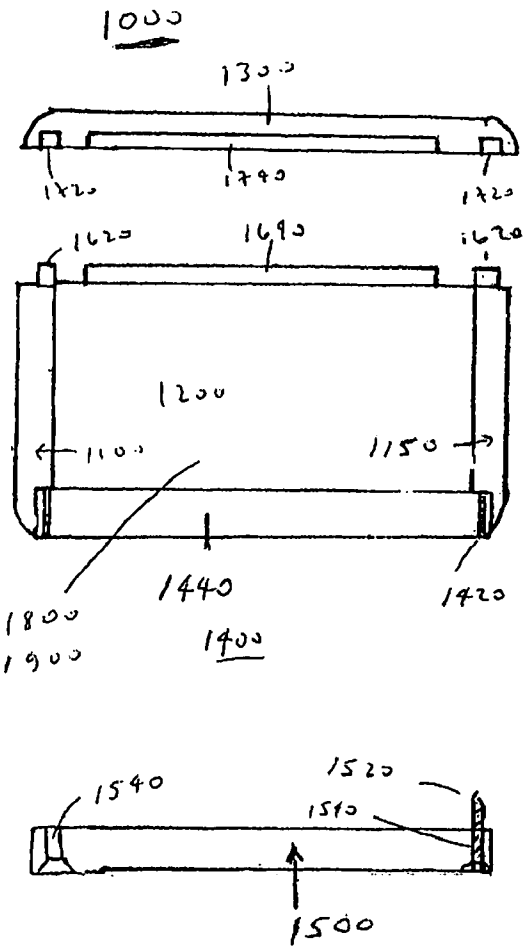
FIG. 2 is a cross-sectional assembly view, taken along line A-A of FIG. 1.

FIG. 2 is a cross-sectional assembly view, taken along line A-A of FIG. 1, and FIG. 3 is a cross-sectional assembly view, taken along line B-B of FIG. 1. Face 1300 can be attached to sides 1100, 1150, and ends 1200, 1250 to form first portion 1400. The attachment can utilize glue, such as a carpenter's and/or weatherproof glue, e.g., Tight-Bond II from Franklin International of Columbus, Ohio. The attachment can utilize a joint, such as a mortise and tenon and/or tongue and groove. For example, face 1300 can comprise one or more side grooves 1720 and/or one or more end grooves 1740 adapted to receive corresponding one or more side tongues 1620 and/or one or more end tongues 1640. Note that the placement of and grooves and tongues, and/or mortises and tenons, is not critical, so long as a sturdy joint is formed. Thus, face 1300 can comprise one or more tongues and/or tenons. Although not shown, either of sides 1100, 1150 can be interlocked, such as via a joint, to either of ends 1200, 1250. The joint can utilize glue, a mortise and tenon construction, and/or a tongue and groove construction. In certain exemplary embodiments, a tenon and/or tongue can have a round cross-section, such as a dowel, and the corresponding mortise and/or groove can have a round cross-section, such as a hole.

First portion 1400 can define a cremains cavity 1800 that can be enclosed to form a cremains space 1900 by attachment of lid 1500, which can closely fit into first portion 1400 and onto a lid seat 1440. Because cremains space 1900 can be substantially airtight, when placing lid 1500 on lid seat 1440, a portion of the air within cremains cavity 1800 can escape from cremains cavity 1800 via vent holes 1540, thereby allowing lid 1500 to mate flushly into first portion 1400. Prior to mating lid 1500 to first portion 1400, glue can be applied to lid seat 1440, first portion 1400, and/or lid 1500, thereby allowing lid 1500 to be permanently sealed to first portion 1400. Screws 1520, which can be made of stainless steel, brass, etc., can project substantially through vent holes 1540 in lid 1500 and interface with receiving holes 1420 in first portion 1400 to attach lid 1500 to first portion 1400, thereby applying sufficient pressure to help any applied glue set properly. Prior and/or afterwards to mating lid 1500 with seat 1440 and/or first portion 1400, glue can be applied to screws 1520, vent holes 1540, and/or receiving holes 1420 to allow the interaction therebetween to seal vent holes 1540, thereby rendering cremains space 1900 substantially airtight. In certain exemplary embodiments, cremains space 1900 can remain substantially airtight when exposed to temperatures ranging from about −30F to about −300F, including all values and subranges therebetween, such as from about −20F to about 180F. In certain exemplary embodiments, cremains space 1900 can comprise a volume of at least about 200 cubic inches.

In certain exemplary embodiments, a protective finish and/or sealant, such as a polyurethane wood finish, can be applied to an exterior surface 1320 of box-urn 1000 to help preserve box-urn 1000 and/or prevent moisture from penetrating box-urn 1000. In certain exemplary embodiments, a pin, plate, and/or plaque, etc. can be adhered to an exterior surface 1320 of box-urn 1000. In certain exemplary embodiments, the pin can relate to a civic society, social club, military unit and/or honor, etc. In certain exemplary embodiments, the plaque can be brass and/or can be engraved with information regarding the deceased, such as name, rank, unit of military service, civic society, birth date, death date, etc. In certain exemplary embodiments, a box-urn can measure approximately 7½ inches to approximately 7⅞ inches by approximately 3½ to approximately 3⅞ inches by approximately 11½ inches to approximately 11⅞ inches. In certain exemplary embodiments, exterior edges and/or corners of box-urn 1000 can be rounded and/or smooth to prevent injuries and/or to ease handling of box-urn 1000. In certain exemplary embodiments, box-urn 1000 can resemble a piece of fine furniture.

Figure 4:
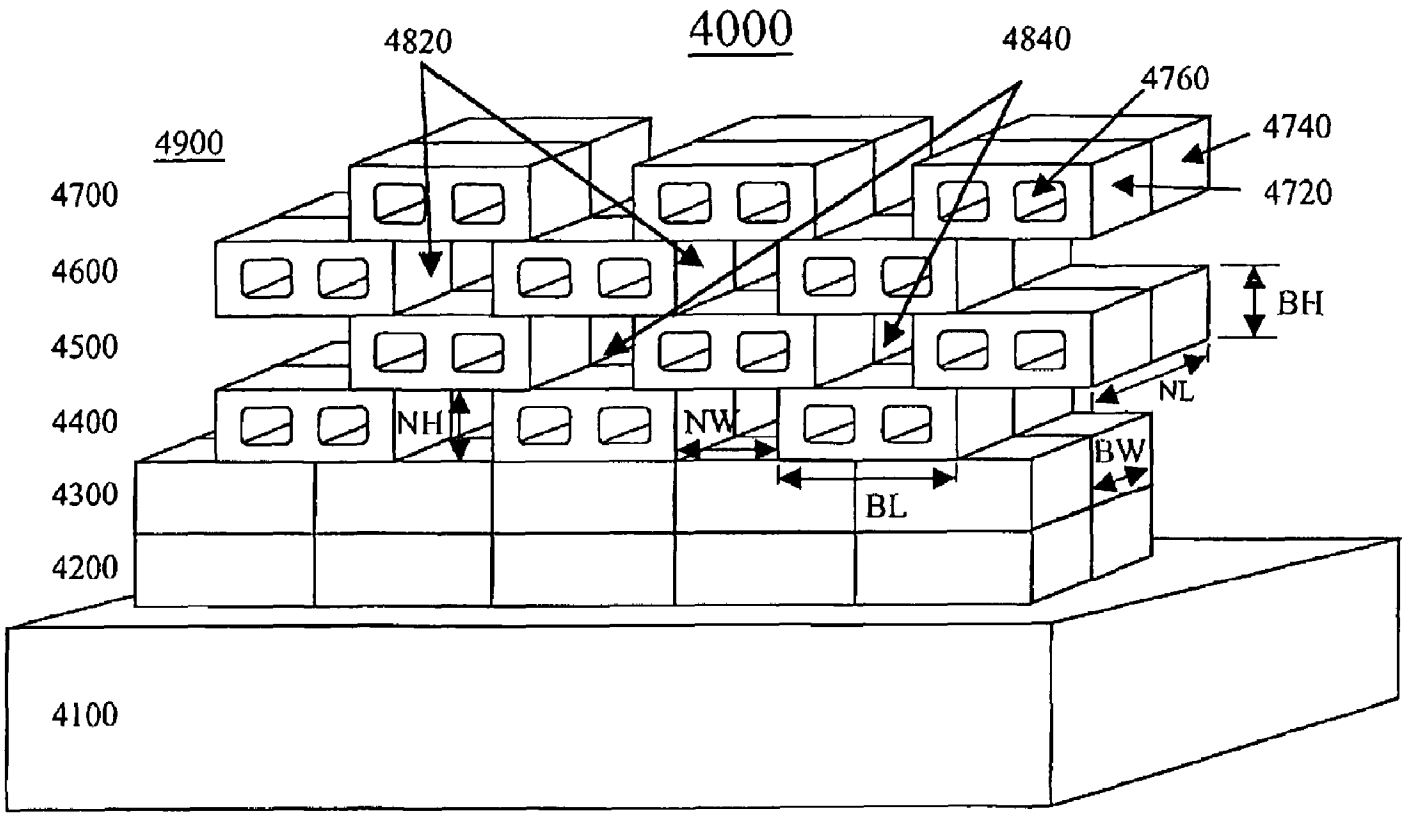
FIG. 4 is a perspective view of an exemplary embodiment of a columbarium wall 4000.

FIG. 4 is a perspective view of an exemplary embodiment of a columbarium wall 4000. In certain exemplary embodiments, columbarium wall 4000 can comprise a foundation 4100, which can be formed of, for example, concrete, stone, and/or structural blocks. In certain exemplary embodiments, supported by foundation 4100 can be one or more foundational courses 4200, 4300, which can be formed of, for example, concrete, stone, and/or structural blocks. Supported by foundational courses 4200, 4300, and/or foundation 4100 can be numerous masonry courses 4400, 4500, 4600, 4700, each of which can be formed of mortared structural masonry blocks 4720, 4740 arranged in a predetermined block pattern 4900. In certain exemplary embodiments, masonry blocks 4720, 4740 can measure approximately 8 inches by approximately 8 inches by approximately 16 inches.

Defined by predetermined block pattern 4900 can be a plurality of niches 4820, 4840, which can be regularly-spaced and/or located external to each masonry block 4720, 4740. Niches 4820, 4840 can be dimensioned to receive at least one box-urn. In certain exemplary embodiments, a niche can receive 2, 3, 4 or more box urns.

In an alternative embodiment, one or more of masonry courses 4400, 4500, 4600, 4700 can be replaced by cast-in-place concrete, curable foam, etc. For example, using forms, such as a stamped metal form which has been embossed to define niches 4820, 4840, one or more of masonry courses 4400, 4500, 4600, 4700, and/or block pattern 4900 can be formed from concrete, spray foam (e.g., pre-foamed and/or foamed-in-place polyurethane, ozone-friendly polyurethane, polyisocyanurate, etc.), etc. In another alternative embodiment, a plastic grid can replace one or more of masonry courses 4400, 4500, 4600, 4700 and/or block pattern 4900, and/or define niches 4820, 4840. Such a grid can be prefabricated and/or can be fabricated in the field. In any event, masonry courses 4400, 4500, 4600, 4700 and/or block pattern 4900, and/or a replacement thereof, can define a wall defining a plurality of niches 4820, 4840.

The niches 4820 of one course 4500 can be offset along a length L (shown on FIG. 5) of wall 4000 with respect to the niches 4840 of a vertically and/or horizontally adjacent course 4600 and/or 4400. Each niche 4820, 4840 can define a niche length NL, niche width NW, and/or niche height NH. Niche length NL can be substantially greater than niche width NW and/or niche height NH. Each block 4720 can define a block length BL, block width BW, and/or block height BH. Block length BL can be substantially greater than block width BW and/or block height BH. Block length BL can extend substantially horizontally. Niche length NL can extend substantially horizontally. Niche length NL can extend substantially perpendicular to block length BL. Each block 4720 can define one or more cavities 4760 that can extend substantially horizontally.

Figure 5:
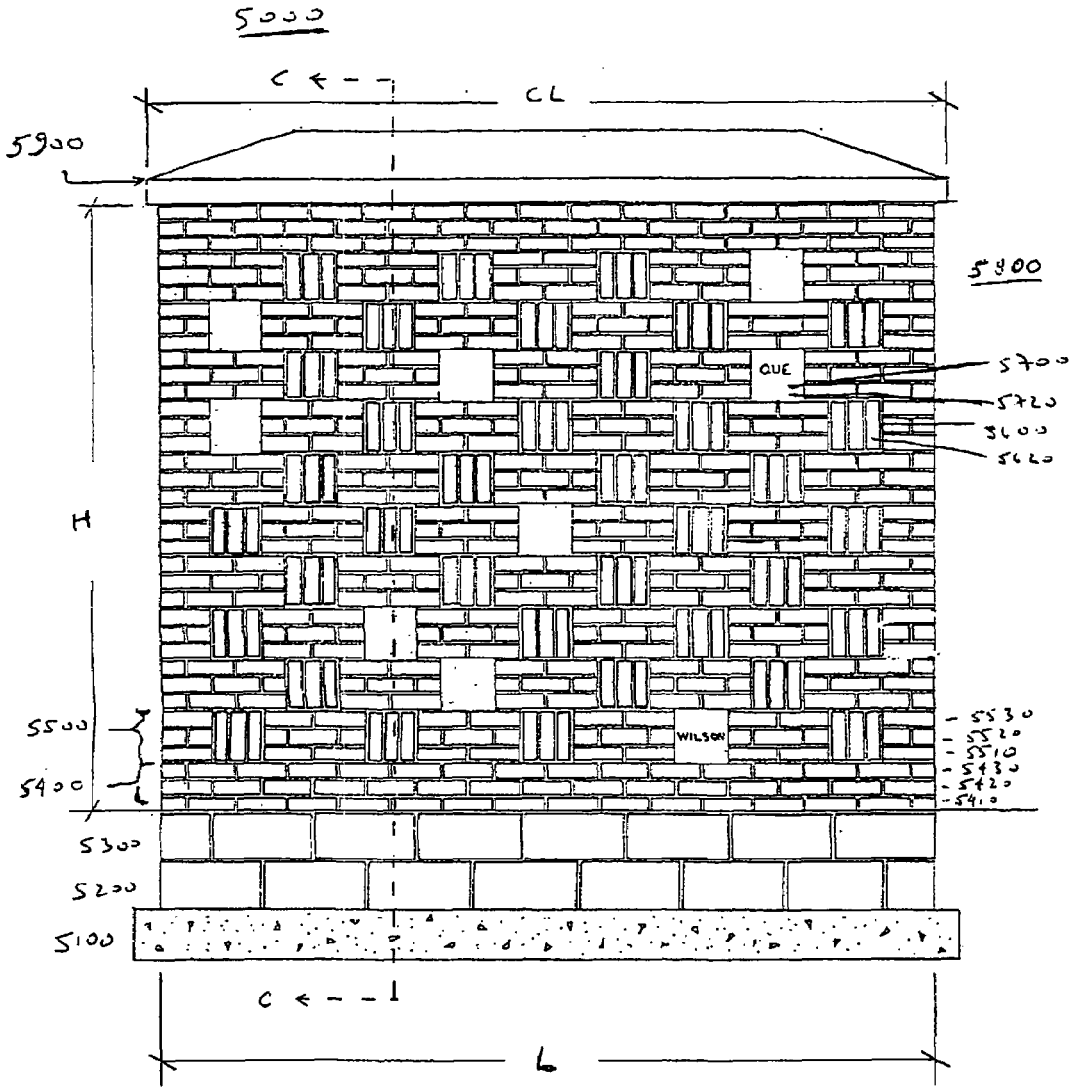
FIG. 5 is a front view of an exemplary embodiment of a columbarium wall 5000.

FIG. 5 is a front view of an exemplary embodiment of a columbarium wall 5000. In certain exemplary embodiments, columbarium wall 5000 can comprise a foundation 5100, which can be formed of, for example, concrete, stone, and/or structural blocks. In certain exemplary embodiments, supported by foundation 5100 can be one or more foundational courses 5200, 5300, which can be formed of, for example, concrete, stone, and/or structural blocks. Supported by foundational courses 5200, 5300, and/or foundation 5100 can be numerous brick layers 5400, 5500, etc., each of which can be formed of mortared structural brick courses 5410, 5420, 5430, 5510, 5520, 5530 arranged in a predetermined brick pattern 5800. Defined by predetermined brick pattern 5800 can be a plurality of niche entrances 5600, 5700 which can be regularly-spaced and/or covered with a plurality of removable bricks 5620 or a plaque or plate 5720. The niche entrances 5600 of one course can be offset along a length L of wall 5000 with respect to the niche entrances 5700 of an adjacent course. Wall 5000 can comprise a cap 5900 that can extend along a length CL that is somewhat larger than length L, thereby overlapping the predetermined brick pattern 5800 and/or protecting wall 5000 from the vertical entrance of water and/or debris. Cap 5900 can be constructed of waterproof material.

In certain exemplary embodiments, wall 5000 can be comprised by a sepulchral facility. In certain exemplary embodiments, one or more facades of wall 5000 can match a décor of a nearby sepulchral facility, church, and/or cemetery. Grounds near a columbarium wall can be landscaped, and/or provided with one or more benches, fountains, gardens, and/or religious symbols.

Figure 6:
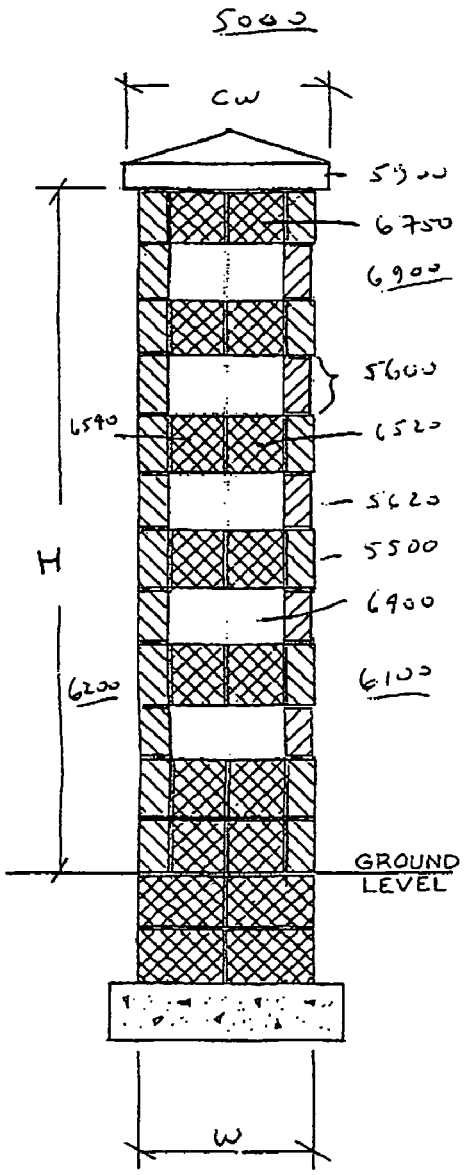
FIG. 6 is a cross-sectional view, taken along line C-C of FIG. 5.

FIG. 6 is a cross-sectional view, taken along line C-C of FIG. 5. As shown, wall 5000 can define a width W. Likewise, cap 5900 can define a cap width CW, which can be somewhat larger than W, thereby overlapping wall facades 6100, 6200 and/or protecting wall 5000 from the vertical entrance of water and/or debris. Cap 5900 can overlay an upper-most or top course 6750 of wall 5000, which can be formed of mortared structural masonry blocks 6520, 6540 arranged in a predetermined block pattern 6900 that defines a plurality of box-urn niches 6400. Adjacent predetermined block pattern 6900 can be a wall facade 6100, which can be constructed of bricks (or stones, etc.) arranged in a predetermined pattern, which can include a plurality of brick layers 5500. Covering an entrance 5600 to a box-urn niche 6400 can be a plurality of bricks (stones, etc.) 5620, which can be oriented such that their lengths or longest dimensions are directed vertically. Bricks 5620 can be inset and/or recessed slightly from the adjacent courses, such as by approximately 0.25 to approximately 1 inch. Adjacent an opposite side of predetermined block pattern 6900 can be a rear wall facade 6200, which can be constructed of bricks, stone, stucco, concrete, etc.

Figure 7:
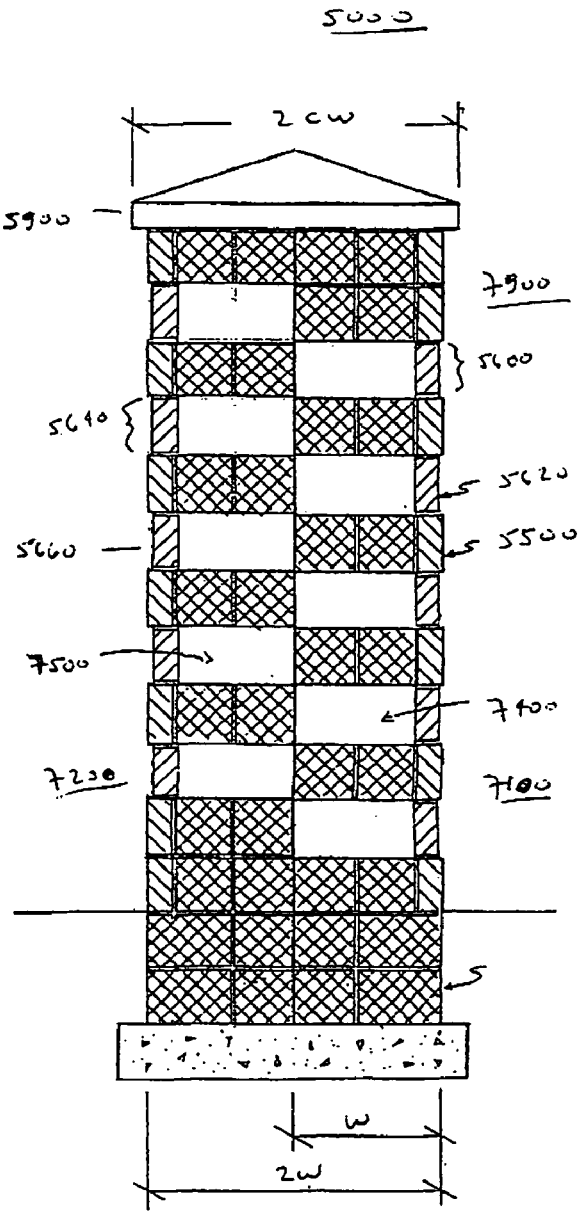
FIG. 7 is an alternative cross-sectional view, taken along line C-C of FIG. 5.

FIG. 7 is an alternative cross-sectional view, taken along line C-C of FIG. 5. As shown, wall 5000 can define a width 2 W, that is approximately twice as wide as the width W of wall shown in FIG. 6. Likewise, cap 5900 can define a cap width 2 CW, which can be somewhat larger than 2 W, thereby overlapping wall facades 7100, 7200 and/or protecting wall 5000 from the vertical entrance of water and/or debris. Wall 5000 can be formed of mortared structural masonry blocks arranged in a predetermined block pattern 7900 that defines a plurality of box-urn niches 7400, 7500, which can be offset from each other with respect to width 2 W. Adjacent predetermined block pattern 7900 can be a wall facade 7100, which can be constructed of bricks arranged in a predetermined pattern, which can include a plurality of brick layers 5500. Covering an entrance 5600 to a box-urn niche 7400 can be a plurality of bricks 5620. Adjacent an opposite side of predetermined block pattern 6900 can be a rear wall facade 7200, bricks arranged in a predetermined pattern. Covering an entrance 5640 to a box-urn niche 7500 can be a plurality of bricks 5660.

Figure 8:
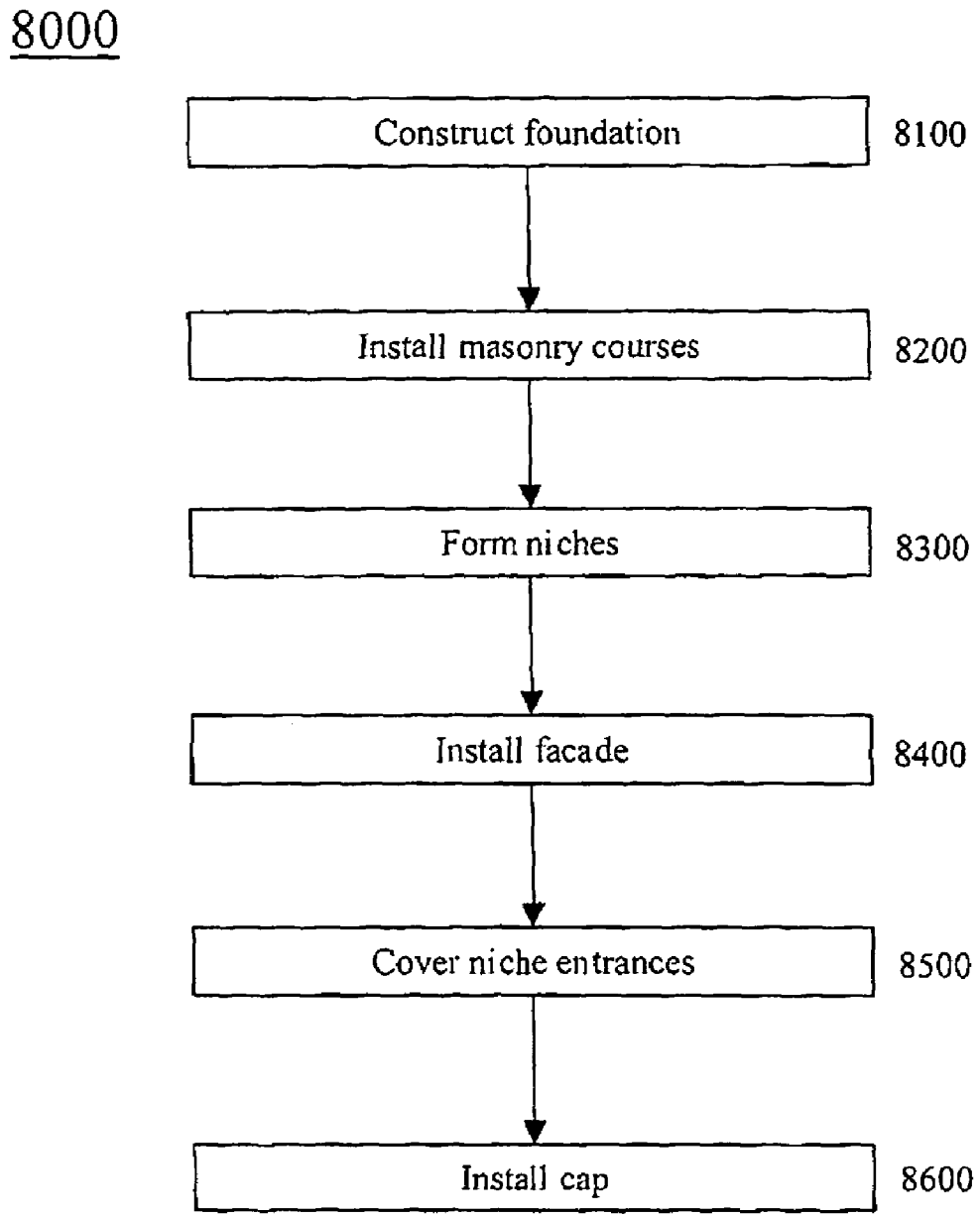
FIG. 8 is a flow diagram of an exemplary embodiment of a method 8000.

FIG. 8 is a flow diagram of an exemplary embodiment of a method 8000 for constructing a columbarium wall. At activity 8100, a foundation can be constructed. At activity 8200, courses of masonry blocks can be constructed in a predetermined pattern. At activity 8300, the masonry blocks of at least certain courses can be arranged to form niches. At activity 8400, one or more facades, formed for example of a predetermined pattern of bricks, can be constructed and/or installed adjacent the predetermined pattern of masonry blocks. A sufficient number of loose bricks can be inserted into the niche for later use. At activity 8500, the niche entrances can be covered, such as using one or more removable mortared bricks (not necessarily the bricks stored in the niche), potentially oriented such that their longest dimension extends vertically. At activity 8600, a cap can be installed over the wall.

Figure 9:
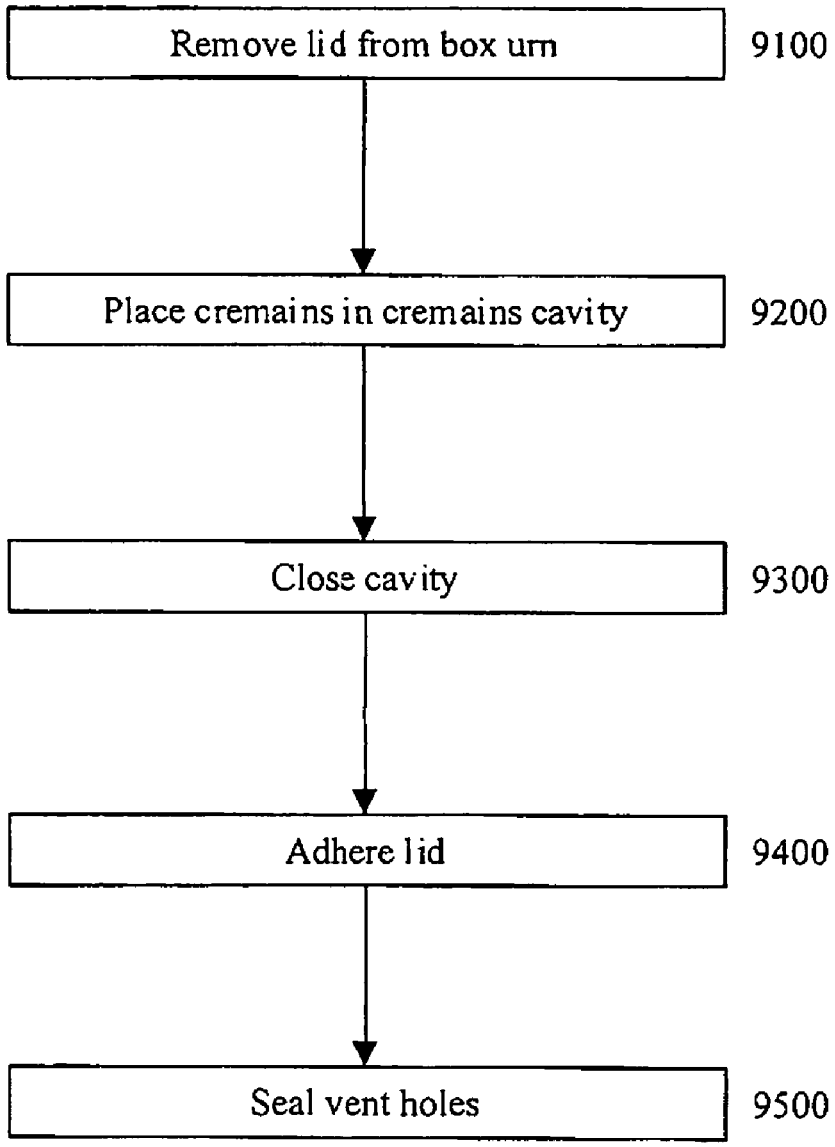
FIG. 9 is a flow diagram of an exemplary embodiment of a method 9000.

FIG. 9 is a flow diagram of an exemplary embodiment of a method 9000 for utilizing a box-urn. At activity 9100, a non-permanently attached lid can be removed from a first portion of a box urn to expose a cremains cavity. At activity 9200, cremains can be placed in the cremains cavity. At activity 9300, the cremains cavity can be closed via applying the lid to the first portion of the urn box while venting the cremains space formed by the mating of the lid to the first portion. At activity 9400, the lid can be adhered to the first portion. At activity 9500, the vent holes can be sealed.

Figure 10:
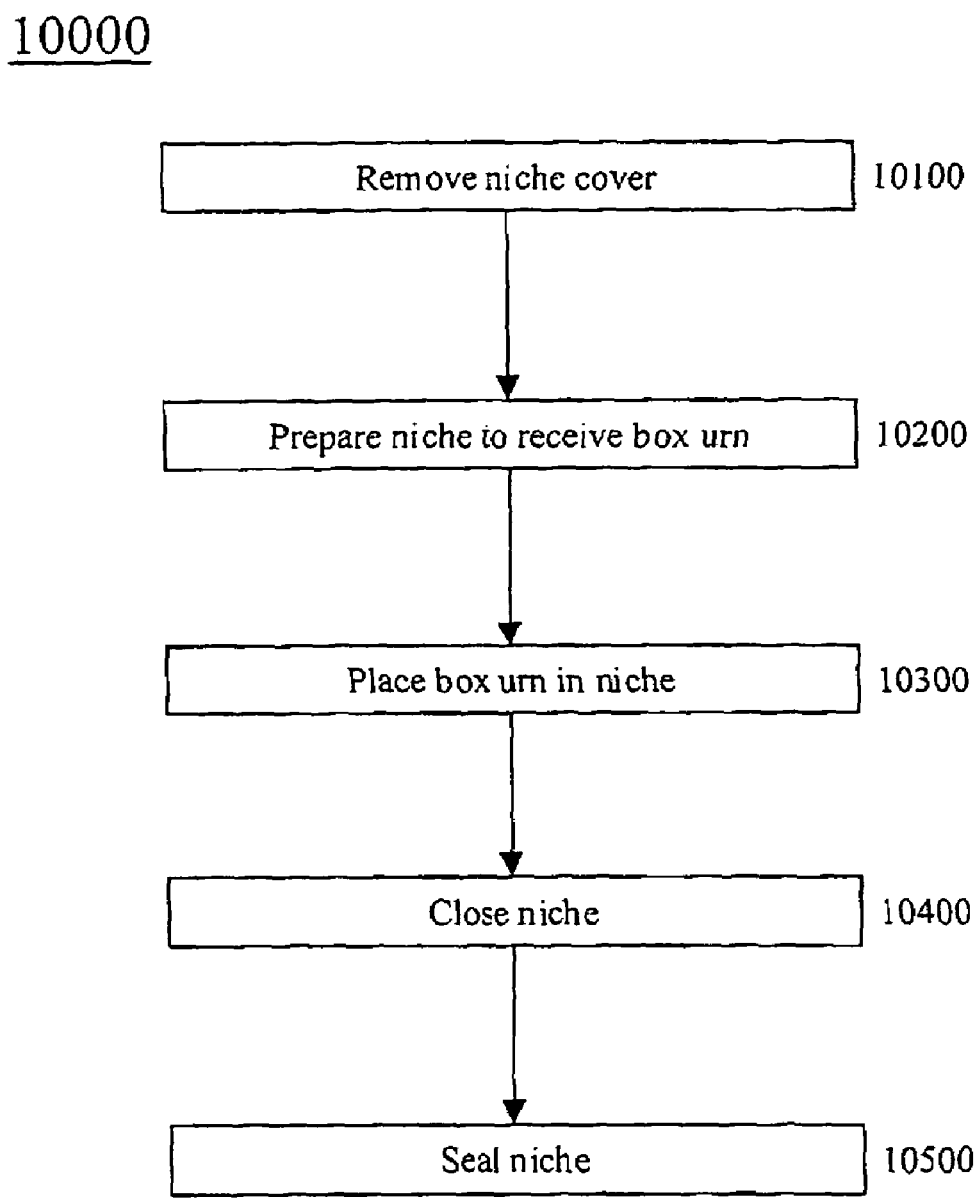
FIG. 10 is a flow diagram of an exemplary embodiment of a method 10000.

FIG. 10 is a flow diagram of an exemplary embodiment of a method 10000 for placing a box-urn in a niche of a columbarium wall. At activity 10100, a covering, such as a plurality of bricks, can be removed from a niche entrance. At activity 10200, the niche can be prepared to receive a box-urn, such as via removing from within the niche any facade bricks knocked into the niche, any stored loose bricks, and/or any loose mortar. At activity 10300, the box-urn can be placed in the niche, such as via sliding the box-urn into the niche. At activity 10400, the niche can be closed, such as via mortaring the previously stored loose bricks across the entrance and/or installing a plate or plaque over the entrance and/or bricks covering the entrance. At activity 10500, the niche can be sealed.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of the appended claims. For example, regardless of the content of any portion (e.g., title, field, background, summary, abstract, drawing figure, etc.) of this application, unless clearly specified to the contrary, there is no requirement for the inclusion in any claim of the application of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render a claim invalid, then any such conflicting information in such incorporated by reference material is specifically not incorporated by reference herein.

What is claimed is:

1. A columbarium wall, comprising a plurality of masonry courses, each of the masonry courses comprising a plurality of mortared structural masonry blocks arranged in a predetermined block pattern, the predetermined block pattern defining a plurality of regularly-spaced niches located external to each structural masonry block and dimensioned to receive at least one box-urn that encloses a volume of at least 200 cubic inches, a sub-plurality of niches defined by a first course from the plurality of masonry courses offset along a length of the wall with respect to a sub-plurality of niches defined by a second course from the plurality of masonry courses, wherein, when installed, each structural masonry block is defined by a block length, a block width, a block thickness, and the block length is greater than the block width and the block thickness, and the block length extends parallel to the length of the columbarium wall.

2. The columbarium wall of claim 1, further comprising a waterproof wall cap installed above an entire top course of the plurality of masonry courses.

3. The columbarium wall of claim 1, further comprising a foundation supporting the plurality of masonry courses.

4. The columbarium wall of claim 1, wherein each niche is defined by a niche length, a niche width, and a niche thickness, and the niche length is greater than the niche width and the niche thickness, and the length extends perpendicular to the length of the columbarium wall.

5. The columbarium wall of claim 1, wherein, when installed, each structural masonry block comprises a cavity that extends substantially horizontally.

6. The columbarium wall of claim 1, wherein each niche extends substantially horizontally.

7. The columbarium wall of claim 1, further comprising:

a facade adjacent the plurality of masonry courses.

8. The columbarium wall of claim 1, further comprising:

a plurality of brick courses adjacent the plurality of masonry courses, each of the brick courses comprising a plurality of mortared bricks arranged in a predetermined brick pattern, the predetermined brick pattern defining a plurality of regularly-spaced niche entrances, each niche entrance covered by a plurality of bricks.

9. A sepulchral facility comprising the columbarium wall of claim 1.

10. A method, comprising constructing a sepulchral facility that comprises the columbarium wall of claim 1.

11. A method, comprising:

placing a box-urn in a niche from the plurality of regularly-spaced niches of the columbarium wall of claim 1.

12. A method, comprising:

on a previously constructed foundation for a columbarium wall defined by a wall length, a wall height, and a wall thickness, installing a plurality of masonry courses, each of the masonry courses comprising a plurality of mortared structural masonry blocks arranged in a predetermined block pattern, the predetermined block pattern defining a plurality of regularly-spaced niches located external to each structural masonry block and dimensioned to receive at least one box-urn that encloses a volume of at least 200 cubic inches, a sub-plurality of niches defined by a first course from the plurality of masonry courses offset along the wall length with respect to a sub-plurality of niches defined by a second course from the plurality of masonry courses, wherein, when installed, each structural masonry block is defined by a block length, a block width, and a block thickness, and the block length is greater than the block width and the block thickness, and the block length extends parallel to the wall length.

13. The method of claim 12, wherein, each masonry course from the plurality of masonry courses comprises at least two adjacent structural masonry blocks.

14. The method of claim 12, wherein each niche is defined by a niche length, a niche width, and a niche thickness, and the niche length is greater than the niche width and the niche thickness, and the length extends perpendicular to the wall length.

15. The method of claim 12, wherein, when installed, each structural masonry block comprises a cavity that extends substantially horizontally.

16. The method of claim 12, wherein each niche extends substantially horizontally.

17. The method of claim 12, further comprising:

constructing said foundation for the columbarium wall.

18. The method of claim 12, further comprising:

capping an entire top course from the plurality of masonry courses with a waterproof material.

19. The method of claim 12, further comprising:

installing a facade adjacent the plurality of masonry courses.

20. The method of claim 12, further comprising:

installing a plurality of brick courses adjacent the plurality of masonry courses, each of the brick courses comprising a plurality of mortared bricks arranged in a predetermined brick pattern, the predetermined brick pattern defining a plurality of regularly-spaced niche entrances, each niche entrance covered by a plurality of removable, lengthwise vertically-oriented, recessed bricks.

* * * * *